US011596993B2

(12) United States Patent
Fu

(10) Patent No.: US 11,596,993 B2
(45) Date of Patent: Mar. 7, 2023

(54) STEEL WIRE DESCALING DEVICE

(71) Applicant: ZHEJIANG MOPPER ENVIRONMENTAL TECHNOLOGY CO., LTD, Zhejiang (CN)

(72) Inventor: Ruxue Fu, Zhejiang (CN)

(73) Assignee: ZHEJIANG MOPPER ENVIRONMENTAL TECHNOLOGY CO., LTD, Zhejiang (CN)

( * ) Notice: Subject to any disclaimer, the term of this patent is extended or adjusted under 35 U.S.C. 154(b) by 347 days.

(21) Appl. No.: 17/064,588

(22) Filed: Oct. 6, 2020

(65) Prior Publication Data

US 2021/0101197 A1 Apr. 8, 2021

(30) Foreign Application Priority Data

Oct. 7, 2019 (CN) ..... 201910947020.2

(51) Int. Cl.
*B21C 43/04* (2006.01)
*B24B 27/00* (2006.01)
*B24B 27/033* (2006.01)

(52) U.S. Cl.
CPC ..... *B21C 43/04* (2013.01); *B24B 27/0076* (2013.01); *B24B 27/033* (2013.01)

(58) Field of Classification Search
CPC . B24B 27/033; B24B 27/0076; B24B 21/025; B21C 43/04
USPC ..... 29/81.04
See application file for complete search history.

(56) References Cited

U.S. PATENT DOCUMENTS 3,702,489 A * 11/1972 Nakamura ..... B23D 79/00 451/190
5,613,286 A * 3/1997 McCabe ..... B21C 43/04 15/88
5,634,363 A * 6/1997 Shozaki ..... B21C 43/04 72/278
5,901,400 A * 5/1999 Fulop ..... B08B 1/04 15/88

FOREIGN PATENT DOCUMENTS

CN 203003653 * 6/2013

* cited by examiner

*Primary Examiner* — Christopher M Koehler
(74) *Attorney, Agent, or Firm* — JCIP Global Inc.

(57) ABSTRACT

The invention relates to a steel wire descaling device. The device includes one or more first steel wire descalers and one or more second steel wire descalers. A descaling roller for removing an oxide scale from a surface of a steel wire is disposed on each of the first steel wire descaler and the second steel wire descaler. The descaling roller of the first steel wire descaler is disposed inclinedly, the descaling roller of the second steel wire descaler is disposed horizontally. By inclinedly brushing the steel wire by using the first steel wire descaler and flatly brushing the steel wire by using the second steel wire descaler, the combination of flat brushing and inclined brushing allows oxide scales to be from steel wires without a blind spot.

10 Claims, 16 Drawing Sheets

STEEL WIRE DESCALING DEVICE

CROSS-REFERENCE TO RELATED APPLICATION

This application claims the priority benefit of China application serial no. 201910947020.2, filed on Oct. 7, 2019. The entirety of the above-mentioned patent application is hereby incorporated by reference herein and made a part of this specification.

BACKGROUND OF THE INVENTION

1. Field of the Invention

The invention relates to a metal surface treatment technology, and particularly relates to a steel wire descaling device.

2. Description of Related Art

It usually takes a while for steel wires to be put into actual use after production. During this period of time, the surfaces of the steel wires may rust for various reasons, which affects the actual use. Therefore, before being used, the rusted surfaces of the steel wires need to be subjected to a descaling treatment.

Currently, it is common to remove oxide scales from the surfaces of the steel wires (i.e., descaling) by performing a pickling process. The principle of the prickling process is to use acid in a pickling solution to chemically react with metal oxide and thereby dissolve the metal oxide and remove the rust and dirt on the surface of a steel material. However, the steel wires need to be washed with a certain amount of clean water and further require a passivation process after the descaling process using the pickling solution. The significant amount of waste water, waste acid, and acid mist produced thus contaminate the environment. If the processes are not carried out properly, the metal may be over-corroded to form pitting marks on the surface. Considering the increasing severity of smog and water and soil pollution across the country, as well as the increasing public awareness for environmental protection, the government is more and more determined to fight against pollution. For companies that still use pickling for removal of oxide scales, such measures are causing increasing pressure and forcing them to take environmental protection seriously. Thus, it is imminent to opt for a novel, environmental friendly descaling apparatus.

Of course, it is possible to physically remove oxide scales. A descaling roller is commonly adopted in the conventional steel wire descaling device. Such descaling roller brushes flatly on the surfaces of the steel wires to remove oxide scales. However, such process only removes oxide scales from the upper/lower or left/right surfaces of steel wires, but is not able to remove oxide scales from the remaining positions. Therefore, there are blind spots in the descaling process using such device.

SUMMARY OF THE INVENTION

To solve the above technical issue, the objective of the invention is to provide a low-pollution steel wire descaling device capable of efficiently removing oxide scales from steel wires without a blind spot.

For the above objective, the invention adopts the following technical solution.

A steel wire descaling device is provided. The steel wire descaling device includes one or more first steel wire descalers and one or more second steel wire descalers. A descaling roller for removing an oxide scale from a surface of a steel wire is disposed on each of the first steel wire descaler and the second steel wire descaler. The descaling roller is disposed to rotate and thereby grind the surface of the steel wire. The descaling roller of the first steel wire descaler is disposed inclinedly, whereas the descaling roller of the second steel wire descaler is disposed horizontally. When the steel wires are arranged in parallel at intervals to pass through the descaling roller of the first steel wire descaler, the plane where the steel wires are located is inclined with respect to a horizontal plane. After the steel wires are entered into the descaling roller of the second steel wire descaler after passing through the descaling roller of the first steel wire descaler, the plane where the steel wires are located is restored to be horizontal.

By inclinedly brushing the steel wire by using the first steel wire descaler and flatly brushing the steel wire by using the second steel wire descaler, the steel wires themselves are turned a small degree along the circumferential direction when the plane where the steel wires are located is turned from being horizontal to inclined and from being inclined to horizontal. Therefore, the combination of flat brushing and inclined brushing allows oxide scales to be removed from steel wires without a blind spot.

Compared with the conventional art, the invention has the following beneficial effects:

1. by inclinedly brushing the steel wire by using the first steel wire descaler and flatly brushing the steel wire by using the second steel wire descaler, the combination of flat brushing and inclined brushing allows oxide scales to be removed from steel wires without a blind spot;

2. by turning the steel wires by using the first steel wire descaler, the angle not possible to clean through flat brushing can be cleaned; and by turning the steel wires back to the original angle by using the second descaler, the two kinds of steel wire descalers are used together to combine inclined brushing and flat brushing, thereby being able to perform a more comprehensive descaling process on the surfaces of the steel wires, more thoroughly remove oxide scales, and eliminate any potential descaling blind spot;

3. by disposing the first sliding rail and the first sliding block, the descaling roller base is movable in the first steel wire descaler, which allow the respective parts of the descaling roller to contact the surfaces of the steel wires, so the grinding rods of the respective parts of the descaling roller can be used uniformly, thereby avoiding excessive use of some of the grinding rods and extending the lifetime of the descaling roller;

4. by disposing the bearing base seat in the first steel wire descaler and allowing it to rotate about the rotation connection point with the descaling roller base to be horizontal, as well as disposing the second sliding rail and the second sliding block to allow the second descaling roller bearing base to be movable back and forth along the second sliding rail, with use of a trolley for roller replacement, automatic replacement of the descaling roller can be easily realized.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
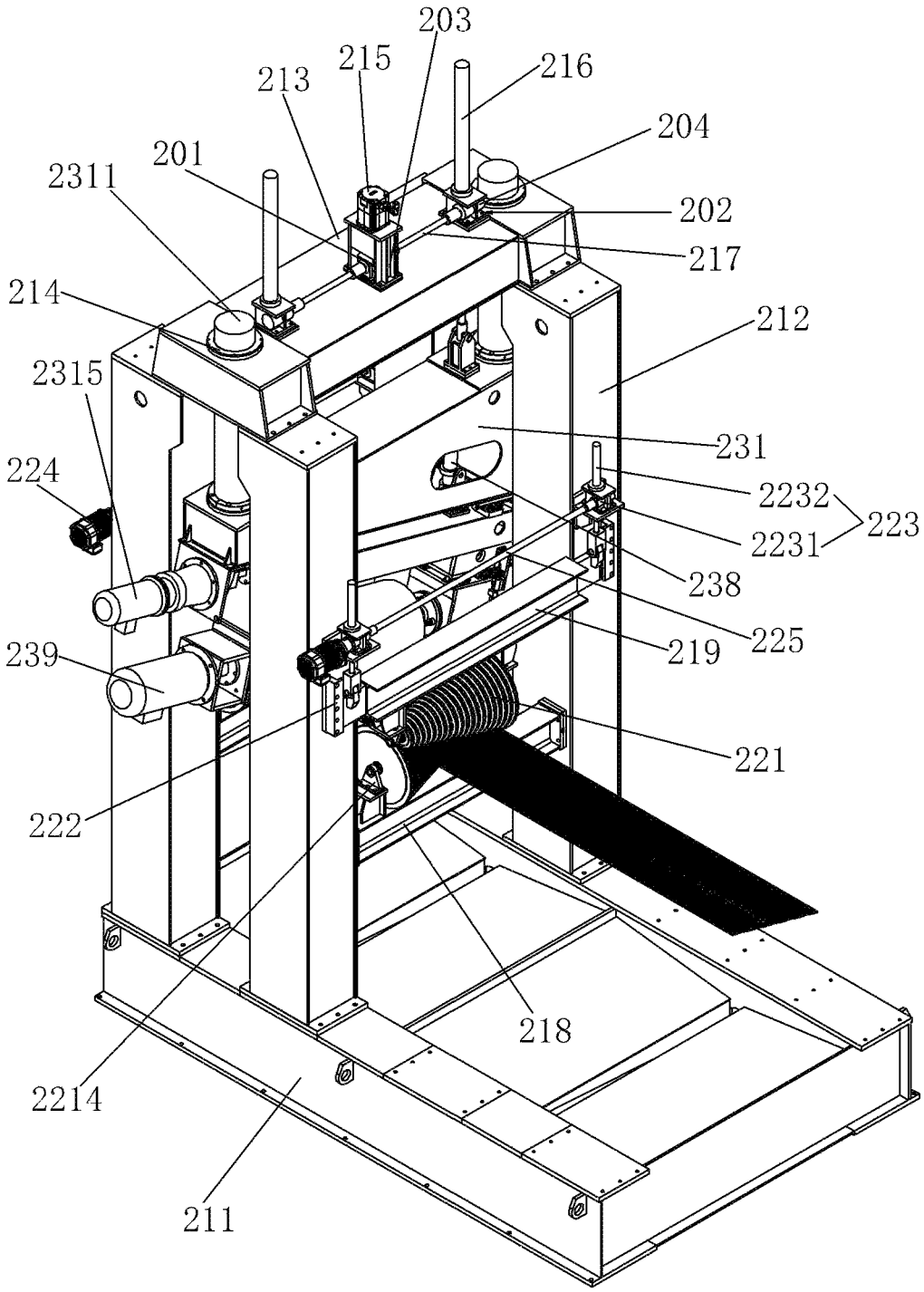
FIG. 1 is the first schematic view illustrating a structure of a first steel wire descaler.
Figure 2:
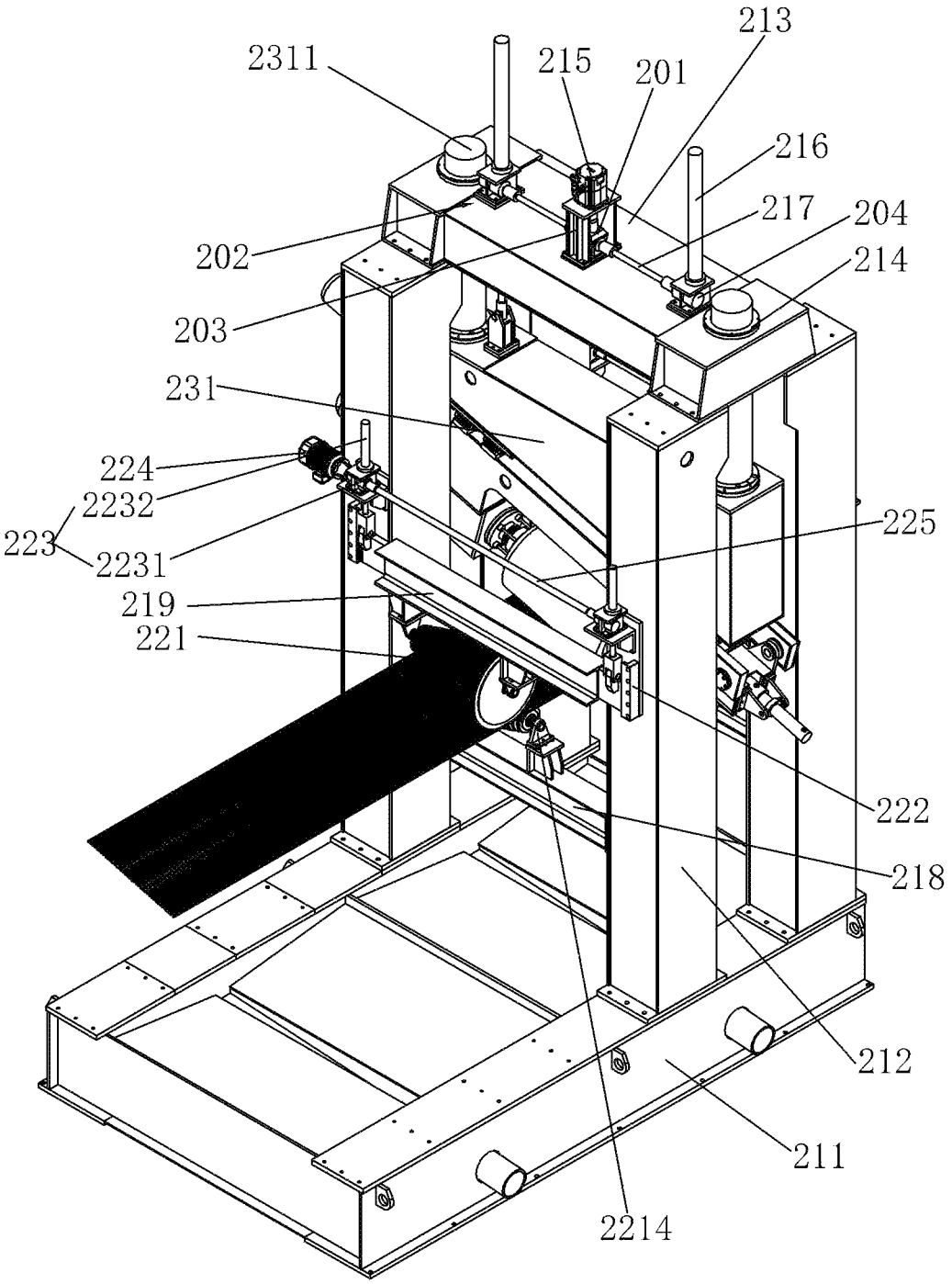
FIG. 2 is the second schematic view illustrating the structure of the first steel wire descaler.

Reference will now be made in detail to the present preferred embodiments of the invention, examples of which are illustrated in the accompanying drawings. Wherever possible, the same reference numbers are used in the drawings and the description to refer to the same or like parts.

In the following, the embodiments of the invention will be described in detail with reference to the accompanying drawings. In the embodiment, front and rear are defined according to the moving direction of the steel wires, left and right are defined as the two sides in the moving direction of the steel wires, and the side close to the steel wires is referred to as the inner side, and the side away from the steel wires is referred to as the outer side.

As shown in FIGS. 1 to 6, a first steel wire descaler includes a descaler frame 21, a steel wire turning mechanism 22, and a steel wire descaling mechanism 23. Here, two steel wire turning mechanisms 22 are provided and the two steel wire turning mechanisms 22 are respectively disposed at the steel wire inlet and the steel wire outlet of the descaler frame 21. The steel wire descaling mechanism 23 is disposed between the two steel wire turning mechanisms 22 on the descaler frame 21.

As shown in FIGS. 1 to 6, the descaler frame 21 includes a base 211 that is rectangular. Two pillars 212 are provided on each of the left and right sides of the base 211. That is, a total of four pillars 212 are provided. The pillars 212 are arranged in a rectangular shape, and a top cover 213 is installed to the top ends of the four pillars 212. Shaft sleeves 214 are disposed at the middle positions on two sides of the top cover 213 and are vertically arranged. On the top cover 213, a lifting motor 215, an angle turner 201, a rotation shaft 217, and a descaling lifting mechanism 202 are disposed. The angle turner 201 is installed at the center of the top cover 213. The lifting mechanism 215 is installed above the angle turner 201 through an installation frame 203. Two descaling lifting mechanisms 202 are provided. The two descaling lifting mechanisms 202 are respectively located on two sides of the top cover 213. Two rotation shafts 217 are provided. The ends of the two rotation shafts 217 are respectively connected with the two sides of the angle turner 201, and the other ends of the two rotation shafts 217 are respectively connected with the two descaling lifting mechanisms 202. The descaling lifting mechanism 202 is a worm gear/worm mechanism and includes a first worm gear 204 and a first lifting stick 216 (which is the worm of the worm mechanism). The other end of the rotation shaft 217 is connected with the first worm gear 204. The lifting motor 215 drives the angle turner 201 to operate, so that the two rotation shafts 217 are rotated synchronously. The rotation shafts 217 drive the first worm gears 204 on the two sides to rotate synchronously, thereby driving the two first lifting sticks 216 to lift/drop synchronously.

As shown in FIGS. 1 to 7, the steel wire turning mechanism 22 includes two conical deflector rollers 221 installed in opposing directions. The deflector roller 221 includes a deflector roller shaft 2211. On the deflector roller shaft 2211, a plurality of deflector bearings 2215 are installed. Two sealing covers 2217 are installed on two end surfaces of the deflector bearings 2215 to prevent dust from entering the inside of the deflector bearing 2215. A round nut 2216 is disposed at one end of the deflector roller shaft 2211, and the deflector bearing 2215 is tightly pressed by tightening the round nut 2216, and the inner ring of the deflector bearing 2215 is fixed. Each deflector bearing 2215 is rotatably connected with a deflector wheel 2212. The diameters of the respective deflector wheels 2212 increase arithmetically from one end to the other end of the deflector roller 221. Bearing support bases 2214 are disposed on two ends of the deflector roller shaft 2211. Each deflector wheel 2212 is independently rotatable about the deflector bearing 2215. By disposing the deflector bearing 2215, the deflector wheel 2212 can rotate more flexibly and smoothly, and the friction resistance can be effectively reduced to prevent the deflector wheel 2212 and the deflector roller shaft 2211 from being worn. In the deflector wheel 2212, a portion near the wheel periphery of the deflector wheel 2212 is reduced to form a reduced part 2218. On the sidewall of the reduced part, a guiding groove 2213 is provided. The depths of the respective guiding grooves 2213 the same. After each steel wire passes through a steel wire separation assembly 12 and is entered into the guiding groove 2213 of the corresponding deflector wheel 2212, the plane on which all the steel wires are located forms an inclined plane, and all the steel wires are located on the inclined plane. The angle included between the inclined plane and the horizontal plane ranges between 5 degrees to 30 degrees. Meanwhile, by disposing the reduced part 2218 and the guiding groove 2213, an interval is kept from one steel wire to another steel wire, so that the steel wires are not too closely arranged and can be conveniently brushed and ground by using the descaling roller.

A lower lateral beam 218 and an upper lateral beam 219 are installed between the two pillars 212 at the inlet of the steel wires. The deflector roller 221 is fixed to the lower end of the upper lateral beam 219 and the upper end of the lower lateral beam 218 through the bearing support bases 2214. At least one of the upper lateral beam 219 and the lower lateral beam 218 is liftable along the vertical direction, and can be fixed after being lifted or dropped. In the embodiment, it is preferable that the upper lateral beam 218 is movable. The specific structure is as follows. Sliding grooves 222 are provided at the same height on the four pillars 212. The two ends of the upper lateral beam 219 are installed in the sliding grooves 222, and the upper beam 219 is vertically movable along the sliding grooves 222. One of the two pillars 212 at the inlet of the steel wires is provided with a second deceleration motor 224. The second deceleration motor 224 is connected with a synchronous rotation link 225. Lateral beam lifting mechanisms 223 are disposed at the same height on the two pillars 212 at the entrance of the steel wires. The lateral beam lifting mechanisms 223 are also worm gear/worm mechanisms. The lateral beam lifting mechanism 223 includes a second worm gear 2231 and a second lifting stick 2232 (which is the worm of the worm gear/worm mechanism). The lower ends of the two second lifting sticks 2232 are respectively connected with the two ends of the upper lateral beam 218. The synchronous rotation link 225 is respectively connected with the second worm gears 2231 of the two lateral beam lifting mechanisms 223. The second deceleration motor 224 drives the synchronous rotation link 225 to rotate, thereby driving the two second worm gears 2231 to rotate synchronously. Accordingly, the second lifting sticks 2232 are moved synchronously in the vertical direction, thereby driving the upper lateral beam 219 to move vertically along the sliding grooves 222. After the second deceleration motor 224 stops driving, the upper lateral beam 219 is also fixed at a position. In order to further stabilize the steel wires, it is preferable that the upper lateral beam 219 and the lower lateral beam 218 are also installed between the two pillars 212 at the outlet of the steel wires and the second deceleration motor 224, the synchronous rotation link 225, and the lateral beam lifting mechanisms 223 are also installed.

As shown in FIGS. 8 to 12, the steel wire descaling mechanism 23 includes an inclined beam 231. The lower end surface of the inclined beam 231 is an inclined surface, whereas other end surfaces are planar surfaces. The inclination angle and the inclination direction of the lower end surface are consistent with the inclination angle and direction of the inclined plane formed by the steel wires. Two guiding shafts 2311 are provided on two sides of the upper end surface of the inclined beam 231. In addition, two lifting shaft bases 2312 are disposed on two sides of the upper end of the inclined beam 231. The two lifting shaft bases 2312 are located between the two guiding shafts 2311. The upper ends of the guiding shafts 2311 pass through the shaft sleeves 214. In addition, the guiding shafts 2311 are fit with the shaft sleeves 214 during the vertical movement of the inclined beam 231. The lower ends of the first lifting sticks 216 are fixed to the lifting shaft bases 2312. First sliding rails 2313 are respectively disposed on two sides of the lower end surface of the inclined beam 231. At least one first sliding block 2314 is installed on each of the first sliding rails 2313. A descaling roller base 232 is connected to the lower ends of the first sliding blocks 2314. In other words, the two sides of the upper end surface of the descaling roller base 232 are respectively fixed to the lower ends of the first sliding blocks 2314. A first deceleration motor 2315 is installed on the narrower side of the inclined beam 231. The first deceleration motor 2315 drives the descaling roller base 232 to move back and forth along the first sliding rails 2313. The entire descaling roller base 232 is parallel to the lower end surface of the inclined beam 231, and extends downward on the higher side of the descaling roller base 232 to form an elbow 2321. A first descaling roller bearing base 235 is installed to the lower end of the elbow 2321. A third deceleration motor 239 is installed on the outer side of the first descaling bearing base 235. The third deceleration motor 239 drives the bearing of the first descaling roller bearing base 239 to rotate. On the lower end of the lower side of the descaling roller base 232, a bearing base seat 237 is installed. The outer end of the bearing base seat 237 is rotatably connected with the descaling roller base 232. A first cylinder 238 is installed inside the inclined beam 231. The lower end of a rod of the first cylinder 238 is connected with the inner end of the bearing base seat 237. Through the drive of the first cylinder 238, the bearing base seat 237 rotates about a rotation connection point between the bearing base seat 237 and the descaling roller base 232. A second sliding rail 2371 is provided at the lower end of the bearing base seat 237. A second sliding block 2372 is installed on the second sliding rail 2371. The lower end of the second sliding block 2372 is fixed to the upper end of a second descaling roller bearing base 236. A second cylinder 2373 is installed on the outer side of the bearing base seat 237. Through the drive of the second cylinder 2373, the second sliding block 2372 slides back and forth along the second sliding rail 2371, thereby controlling the position of the second descaling roller bearing base 236. In an operational state, the two ends of a descaling roller 233 are respectively installed in the first descaling roller bearing base 235 and the second descaling roller bearing base 236.

A roller mounting operation mainly relies on the axial movements of the bearing base seat 237 and the first descaling roller bearing base 235. Therefore, it is difficult for teeth of an outer gear 2331 to be directly aligned with the tooth gaps of an inner gear 2351. To address this issue, the embodiment provides the following configuration.

Figure 13:
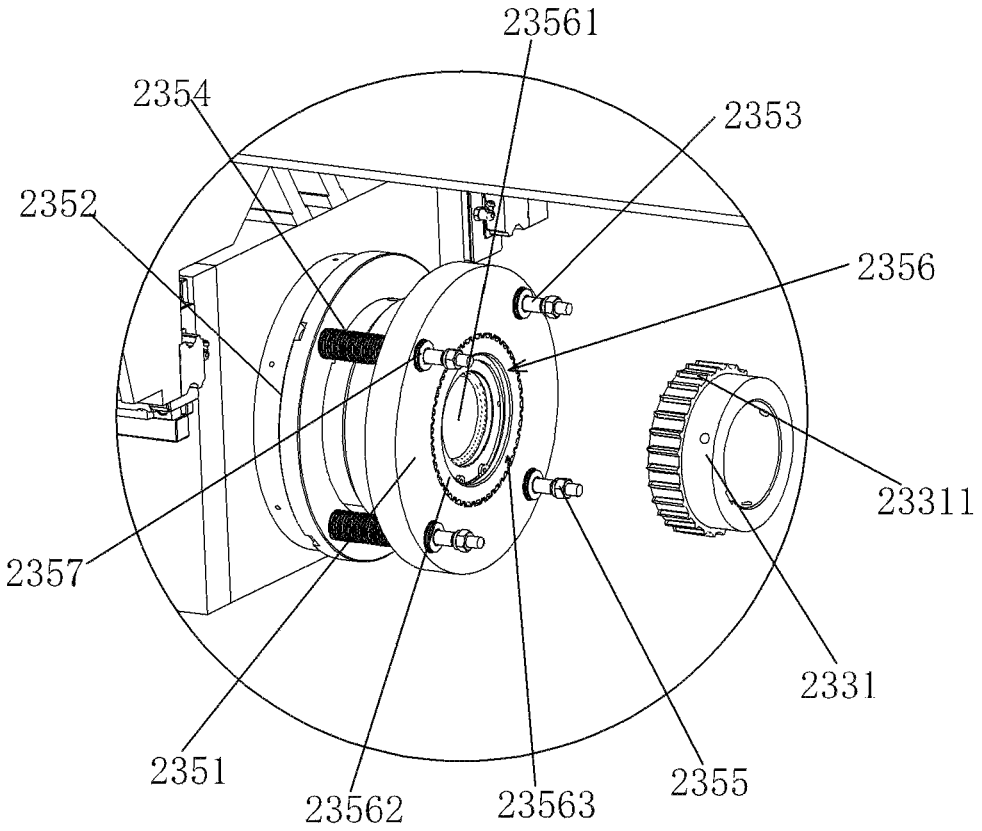
FIG. 13 is a schematic view illustrating matching among an outer gear, an inner gear, and an elastic auxiliary mechanism.

As shown in FIG. 13, elastic auxiliary mechanisms are installed on opposing sides of the first descaling roller bearing base 235 and the second descaling roller bearing base 236. The elastic auxiliary mechanism includes an installation seat 2352, which is circular. The installation seats 2352 are rotatably installed on the first descaling roller bearing base 235 and the second descaling roller bearing base 236. Four screws 2353 are evenly installed on an end surface of the installation seat 2352. A disc spring 2354 is sleeved on each screw. The four screws 2353 pass through the inner gear 2351. The installation seat 2352 is synchronously rotatable with the inner gear 2351. One end of the disc spring 2354 contacts the installation seat 2352, and the other end of the disc spring 2354 contacts the gear surface of the inner gear 2351. An adjustment nut 2355 and a pad 2357 are installed on the other end of the screw 2353. The outer gear 2331 is sleeved on and fixed to a shaft head 2336 of each of the two ends of the descaling roller 233. The descaling roller 233 is installed by engaging the inner gear 2351 and the outer gear 2331 with each other. The four screws 2353 pass through the inner gear 2351, and a rear end surface 23514 of the inner gear 2351 abuts against the disc spring 2354, while a front end surface 23515 abuts against the pad 2357. A gear shaft 2356 is engaged and sleeved with the inner gear 2351. An exposed end 23562 of the gear shaft 2356 has a chamber 23561 for the shaft head 2336 to insert. The gear shaft 2356 is constantly engaged with the inner gear 2351. As shown in FIG. 13, the exposed end 23562 of the gear shaft 2356 is retracted inwardly with respect to the front end surface 23515 of the inner gear 2351 to provide a space 23563 for the outer gear 2331 to enter.

As shown in FIG. 13, gear teeth are distributed along the circumferential direction on the inner circle of the inner gear 2351. In addition, the gear teeth of the inner gear 2351 include two types of gear teeth, i.e., long teeth 23511 and short teeth 23512 staggered along the circumferential direction. The short tooth 23512 is reduced from the front end surface 23515 of the inner gear 2351 toward the inner circle along the axial direction to provide a preset gap 23513. In other words, the preset gap 23513, which is greater, is provided between two adjacent long teeth 23511, and smaller gaps are formed between the two adjacent long teeth 23511 and the short tooth 23512.

Figure 14:
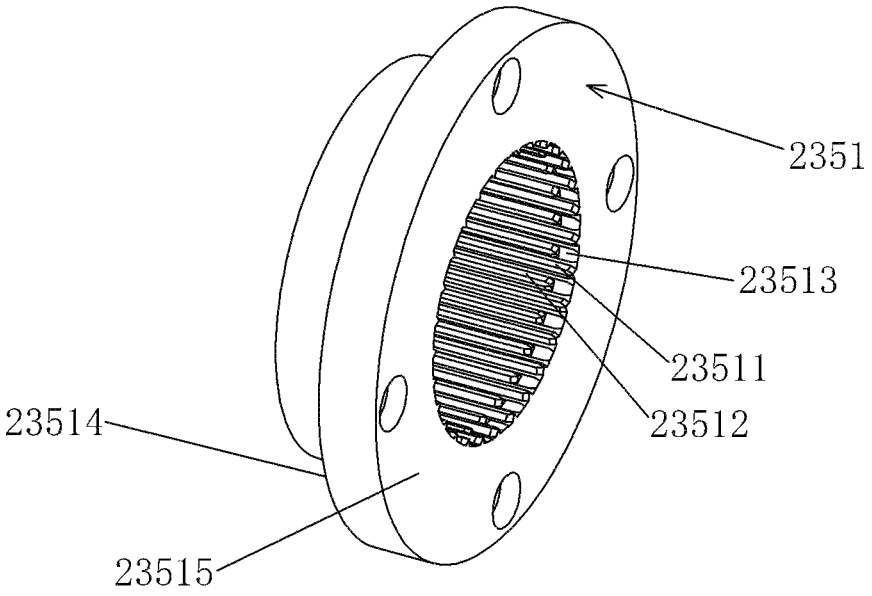
FIG. 14 is a schematic view illustrating a structure of the inner gear.

As shown in FIG. 14, the diameter of the outer gear 2331 is equal to the diameter of the gear shaft 2356. The outer gear 2331 is a comb gear, and teeth 23311 that are loosely arranged along the circumferential direction on the outer circumference of the outer gear 2331. In other words, the number of the teeth 23311 may be a half or a quarter of the sum of the long and short teeth of the inner gear 2351. It is preferable that the sum of the long teeth 23511 and the short teeth 23512 is equal to twice of the number of the teeth 23311 of the outer gear 2331. For example, the sum of the long and short teeth of the inner gear may be 44, whereas the number of the teeth 23311 of the outer gear is 22.

By engaging and sleeving the gear shaft with the inner gear, the inner gear and the gear shaft are fixed to each other in the circumferential direction, and whereas the inner gear 2351 is movable along the shaft direction. During the process of installing the descaling roller, the shaft heads 2336 at the two ends of the descaling roller firstly enter the chambers 23561 of the gear shafts 2356. Then, as shown in FIG. 13, the outer gears 2331 at the two ends of the descaling roller approach the front end surfaces 23515 of the inner gears 2351. Since the descaling roller is position-limited or remains unmoved in the axial direction, the outer gears 2331 do not move, whereas the gear shafts 2356 and the inner gears 2351 continues moving. In addition, the inner gears 2351 are pressed by the outer gears 2331 in opposite directions, and the disc springs 2354 are compressed to generate an elastic force. Meanwhile, the output end of the third deceleration motor 239 drives the gear shaft on the first descaling roller bearing base 235 to rotate. When the preset gaps 23513 are aligned with the teeth 23311, the inner gears 2351 are moved backward through the acting of the elastic forces, and the outer gears 2331 firstly enter the spaces 23563. Meanwhile, the teeth 23311 of the outer gears enter the larger preset gaps 23513 formed between the long teeth in the inner gears. In such case, the teeth 23311 of the outer gears are refrained from entering the gaps between the long teeth 23511 and the short teeth 23512. For example, the teeth 23311 abut against the short teeth 23512 of the inner gears 2351, and the disc springs 2354 are pressed again by the inner gears 2351 to generate elastic forces. At this time, the gear shafts 2356 continue rotating. When the teeth 23311 are aligned with the smaller gaps between the long teeth 23511 and the short teeth 23512, the disc springs 2354 again release elastic forces to push the inner gears 2351 back toward the direction of the descaling roller. Eventually, the teeth 23311 enter the smaller gaps between the long teeth 23511 and the short teeth 23512, and the inner gears 2351 and the outer gears 2331 are sleeved and engaged with each other. Accordingly, the power connection between the inner gears 2351 and the outer gears 2331 is realized, and the descaling roller 233 is thus rotatable. The design of the outer gear as a comb gear makes it convenient to engage with the inner gear.

Figure 15:
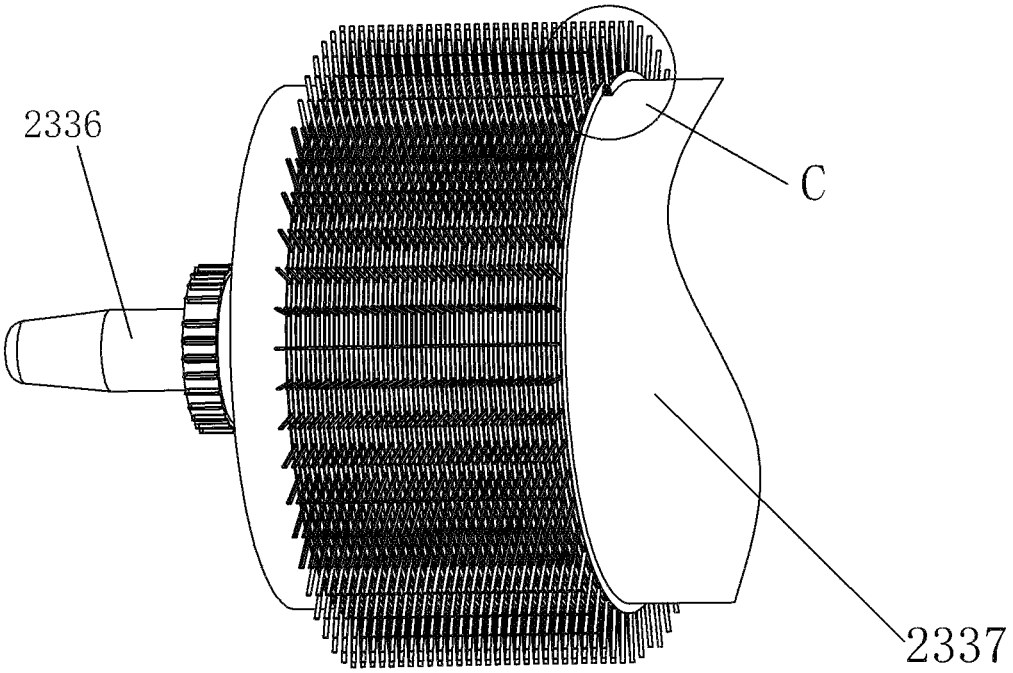
FIG. 15 is a partial structural view illustrating a descaling roller.
Figure 16:
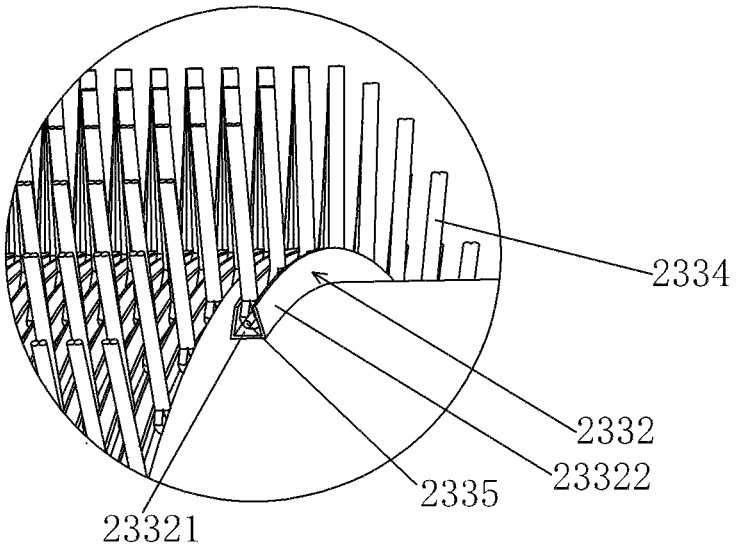
FIG. 16 is a partially enlarged view of C in FIG. 15.

As shown in FIGS. 15 to 16, the descaling roller 233 includes a roller core 2337. The surface of the roller core 2337 is covered by a winding tape 2332 wound from one end to the other end of the roller core 2337. The two ends of the winding tape 2332 are fixed after the winding tape 2332 completely covers the surface of the roller core 2337. The winding tape 2332 exhibits a structure with a wider bottom and a narrower opening, and includes a bottom plate 23321 and side plates 23322 on the two sides of the bottom plate 23322. The side plates 23322 gradually converge from the bottom toward the top. The distance between the two side plates at the top is about a half of the distance between the two side plates at the bottom. A metal wire 2335 is wound on the bottom plate 23321 of the winding tape 2332. Grinding rods 2334 are evenly distributed on and tied to the metal wire 2335. The grinding rods 2334 are brush bars formed by a resin-based body. In the resin-based bar-like structure, rigid grinding particles made of, for example, any one of diamond, silicon dioxide, aluminum oxide are provided. By rotating the descaling roller, the grinding rods brush and grind the steel wires. While the grinding rods are being consumed, the grinding particles of the grinding rods contact the surfaces of the steel wires to remove oxide scales through grinding.

The grinding rod 2334 is wound on the metal wire 2335 and folded in half at the center. After being folded, the halves of the folded grinding rod are closely arranged toward each other to extend out of the two ends of the opening at the top end of the winding tape 2332. The sum of the diameter of the metal wire and two times of the diameter of the grinding rod 2334 is less than the width of the bottom plate 23321 but greater than the distance between the top ends of the side plates 23322. In addition, two times of the diameter of the grinding rod 2334 is substantially equal to the distance between the top ends of the side plates 23322. Here, being "substantially equal" means that two times of the diameter of the grinding rod 2334 is equal to or slightly smaller than the distance between the top ends of the side plates 23322. Therefore, the grinding rods 2334 may be considered as being "planted" in the winding tape 2332 by means of the metal wire 2335.

With such arrangement of planting the grinding rods 2334 in the winding tape 2332, it only requires to wind the winding tape 2332 on the surface of the descaling roller and fix the two ends. Therefore, it is easy to install and remove the winding tape, as compared to the conventional installation using soldering, which makes not only the installation but also removal difficult.

There are two types of first steel wire descalers. The two types have the same structure, except for a difference is that the descaler frame 21 is arranged higher in one of the two types, the steel wires are located inclinedly below the descaling roller and parallel to the roller surface of the descaling roller, and the descaling roller removes oxide scales from the inclined upper surfaces of the steel wires. The descaler frame 21 of the other type is arranged lower, the steel wires are located inclinedly above the descaling roller and parallel to the roller surface of the descaling roller, and the descaling roller removes oxide scales from the inclined lower surfaces of the steel wires.

The second steel wire descaler has a more common structure, in which the descaling roller is installed horizontally to remove oxide scales from the steel wires. There are also two types for the second steel wire descaler. The structures of the two types are completely the same, except for a difference in the size of the descaler frame. In one of the two types, the descaling roller contacts the lower surfaces of the steel wires to remove oxide scales, while in the other type, the descaling roller contacts the upper surfaces of the steel wires to remove oxide scales.

As shown in FIGS. 20 to 25, the second steel wire descaler includes a second descaler frame 31, a guiding roller 32, and a liftable descaling mechanism 33. The liftable descaling mechanism 33 is disposed at the upper part of the second descaler frame 31, and is configured to perform a descaling process on the surfaces of the steel wires. The guiding roller 32 is disposed on a side of the second descaler frame 31 below the liftable descaling mechanism 33 to turn the inclined steel wires to be horizontal and prevent the steel wires from moving vertically.

The second descaler frame 31 includes a second base 311, side plates 312 located on the left and right sides of the second base 311, and an upper installation part 313 which is in a rectangular shape formed by a metal plate and disposed at the upper ends of the side plates 312. Two vertical beams 34 are disposed on a side of the second base 311 where the steel wires are entered. The lower ends of the two vertical beams 34 are connected with the second base 311. The upper ends of the two vertical beams 34 are connected with the upper installation part 313.

The guiding roller 32 includes two gathering rollers 321 arranged in parallel up and down. The two gathering rollers 321 are closely arranged to each other or even fit to each other. The two gathering rollers 321 are disposed horizontally. The two ends of the gathering rollers 321 are respectively installed to the two vertical beams 34. On the surface of the gathering roller 321, a plurality of annular-shaped, groove-like roller paths 3211 are evenly arranged. The roller paths 3211 respectively correspond to each other between the two gathering rollers 321. After passing through the roller paths 3211, the steel wires are changed from an inclined state to a horizontal state, and the steel wires are turned back to the original state. The gathering roller 321 adopts a combination of a special bearing shell and a standard bearing, and is formed by pressing.

The liftable descaling mechanism 33 includes an upper beam 331, a work general beam 332, a third descaling roller bearing base 333, and the descaling roller 233. The upper beam 331 is installed on the upper installation part 313, and the work general beam 332 is disposed below the upper beam 331. A second lifting motor 335, a second angle turner 336, second connection shafts 337, and second lifting mechanisms 338 are disposed on the upper beam 331. The second angle turner 336 is located at the center of the upper beam 331. The second connection shafts 337 are installed on two sides of the second angle turner 336. One end of the second connection shaft 337 is installed to the second angle turner 336, whereas the other end of the connection shaft 337 is fit with the second lifting mechanism 338. The second lifting motor 335 is connected with the second angle turner 336, and is configured to drive the second connection shafts 337 to rotate, thereby driving the second lifting mechanisms 338 to operate. The lower end of the second lifting mechanism 338 is connected with the work general beam 332, and the work general beam 332 is movable in the vertical direction through the drive of the lifting mechanism 338. Two third descaling roller bearing bases 333 are provided. The two third descaling roller bearing bases 333 are respectively installed on two sides of the lower end of the work general beam 332. The two ends of the descaling roller 233 are respectively installed on the two third descaling roller bearing bases 333. To ensure stable operation of the liftable descaling mechanism 333, four second shaft sleeves 339 are disposed on each of the two sides of the upper beam 331. In addition, four second guiding shafts 334 matching the second shaft sleeves 339 are also disposed on each of the two sides of the work general means 332, and the second guiding shafts 334 pass through the shaft sleeves 339.

Figure 17:
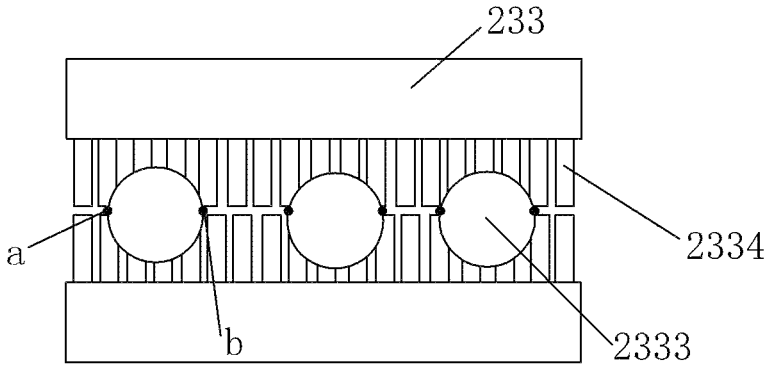
FIG. 17 is a schematic view illustrating mechanically removing oxide scales by flatly brushing surfaces of steel wires before the improvement.

FIG. 17 is a schematic view illustrating a conventional process for removing oxide scales from the surfaces of the steel wires. In the conventional descaling mechanism, the descaling rollers 233 only flatly brush the upper and lower surfaces of steel wires 2333. Because of the circular structure of the cross-section of the steel wire, the pressure exerted by the grinding rod 2334 of the descaling roller 233 to the steel wire 2333 gradually decreases toward the portions on the left and right sides of the steel wire 2333, and the grinding force also decreases. As a result, a descaling blind region a and a descaling blind region b are present within regions within an angle of 5 degrees from a diameter parallel to the central axis of the descaling roller 233.

Figure 3:
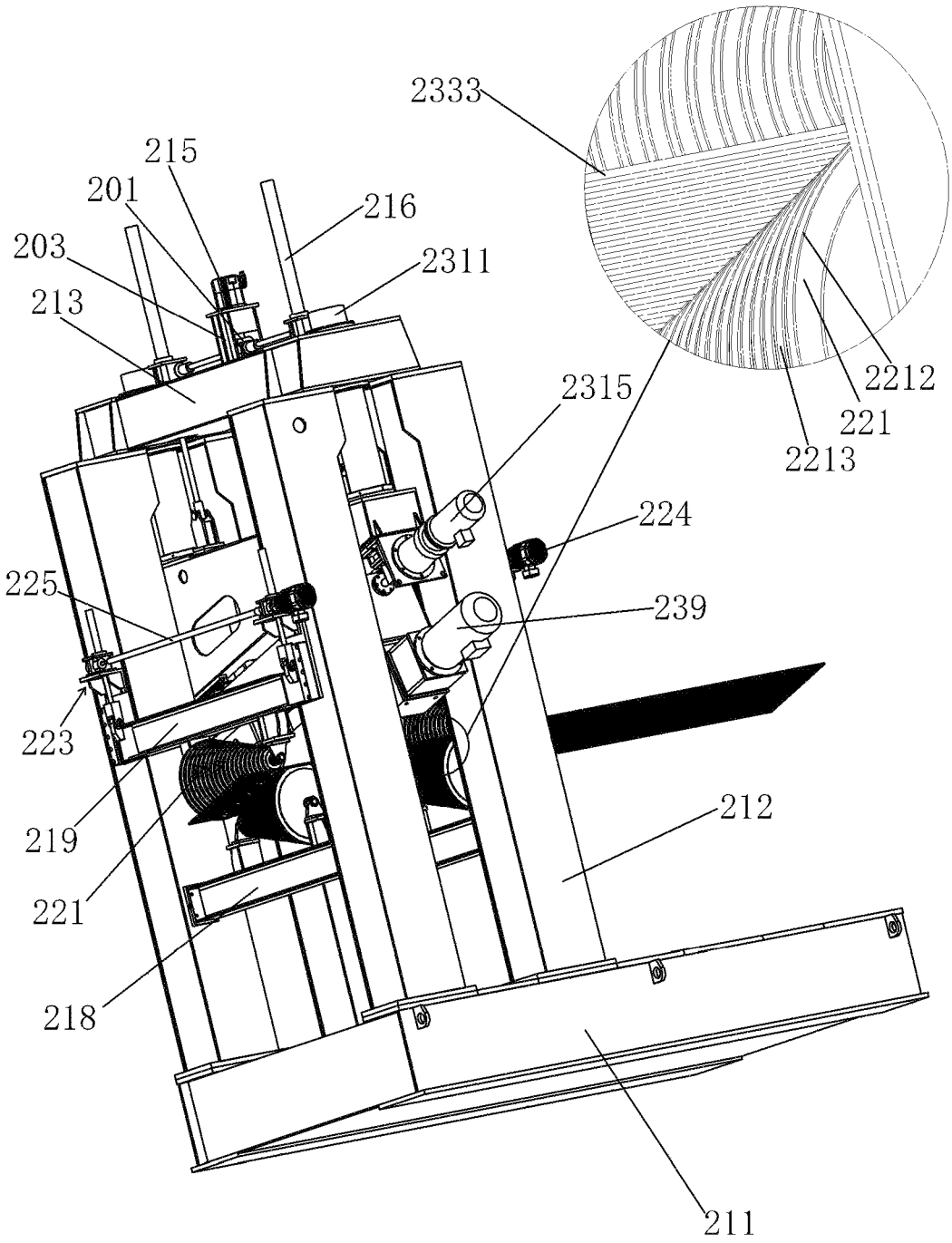
FIG. 3 is the third schematic view illustrating the structure of the first steel wire descaler.
Figure 4:
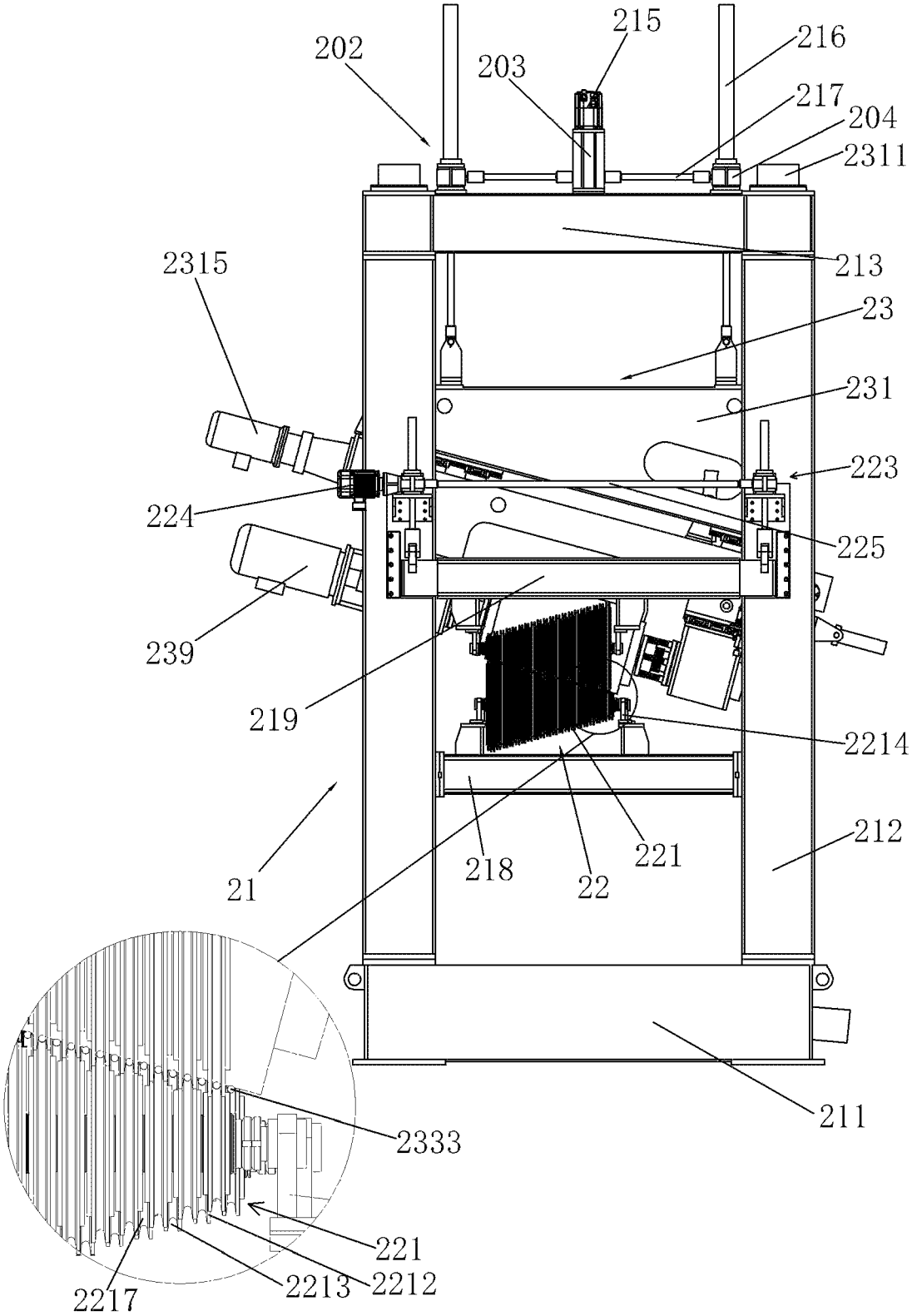
FIG. 4 is the fourth schematic view illustrating the structure of the first steel wire descaler.
Figure 5:
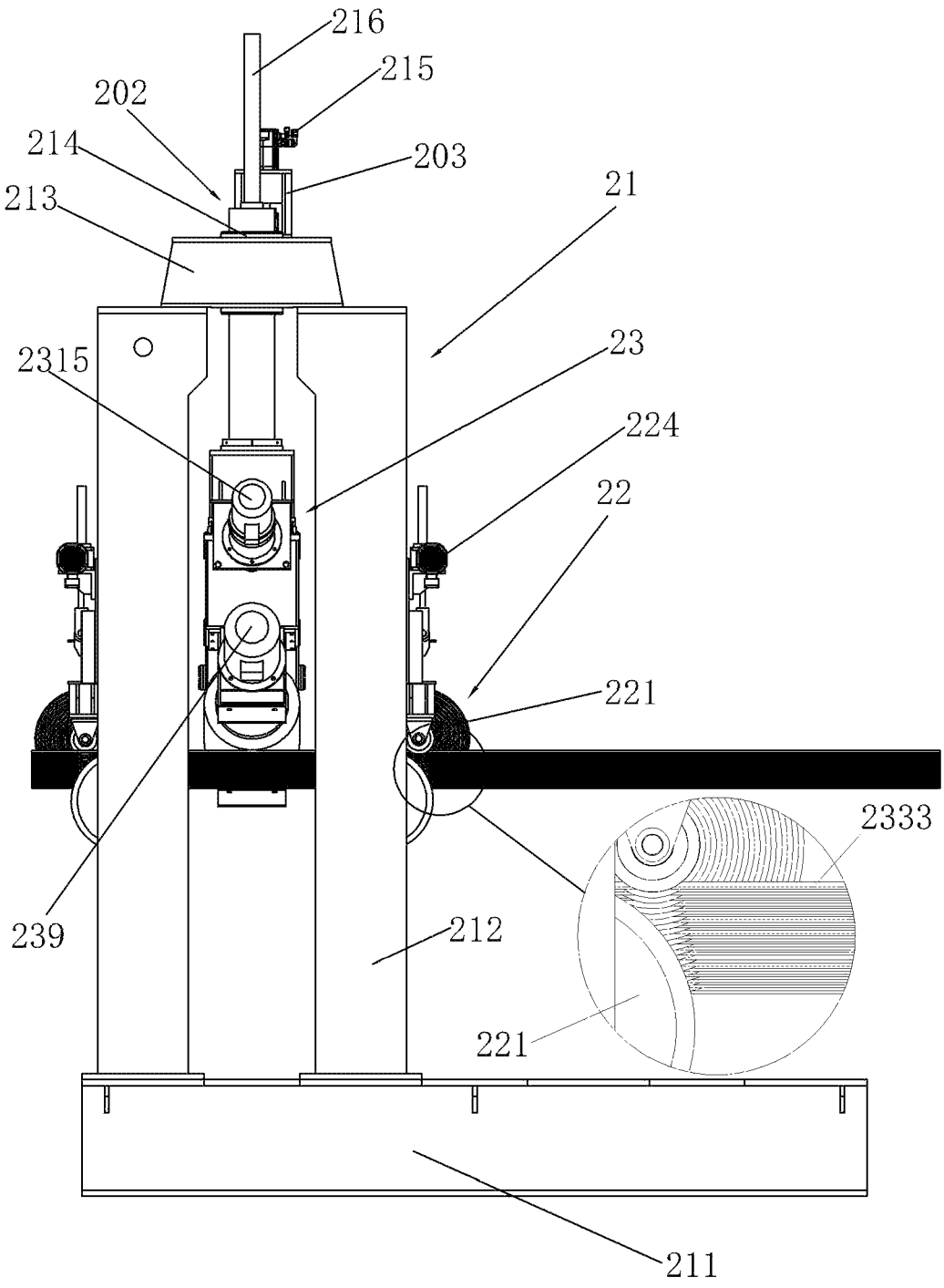
FIG. 5 is the fifth schematic view illustrating the structure of the first steel wire descaler.
Figure 6:
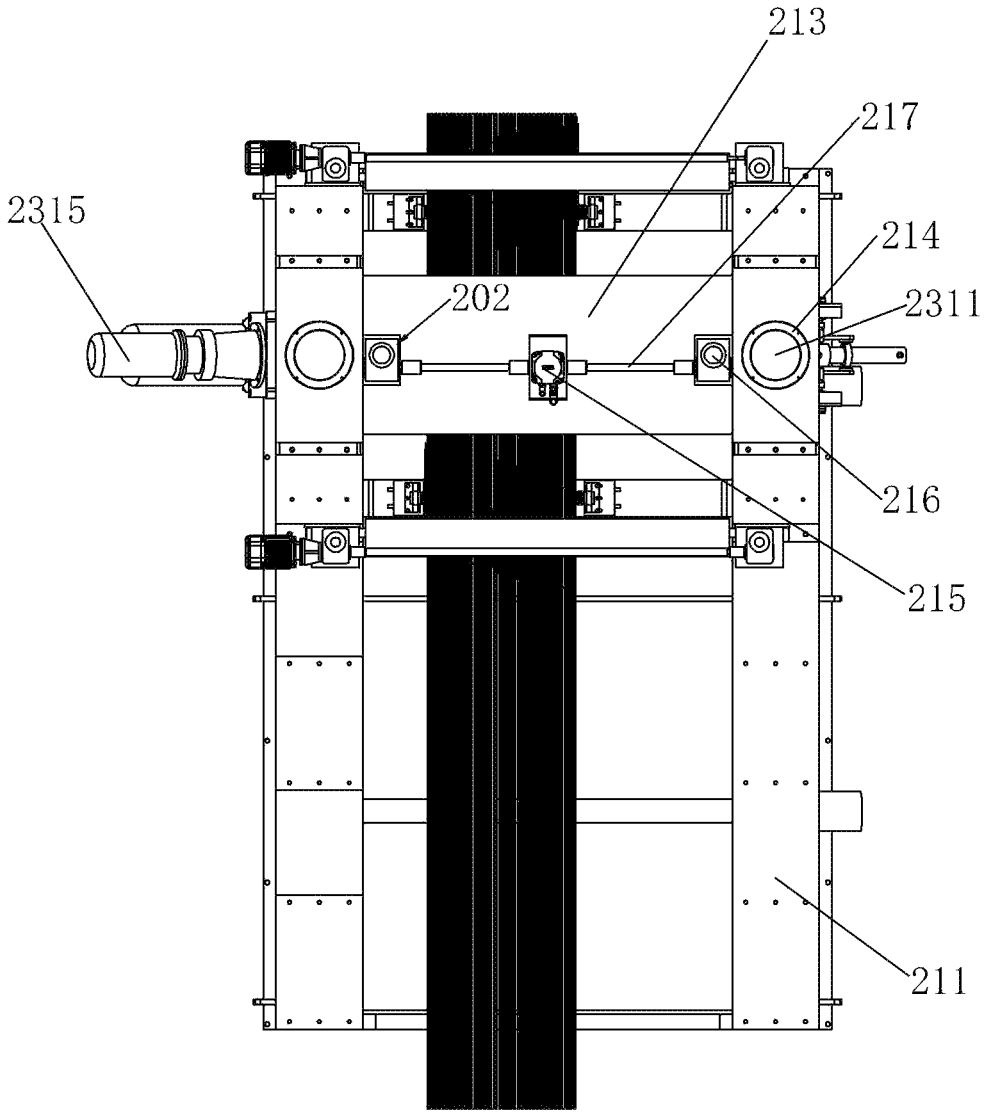
FIG. 6 is the sixth schematic view illustrating the structure of the first steel wire descaler.
Figure 7:
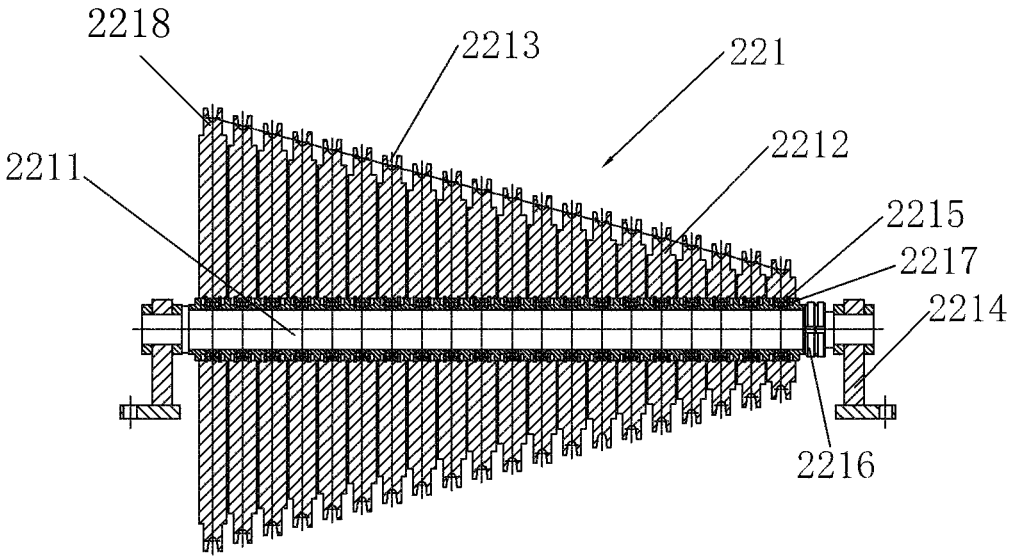
FIG. 7 is a schematic view illustrating a deflector roller.
Figure 8:
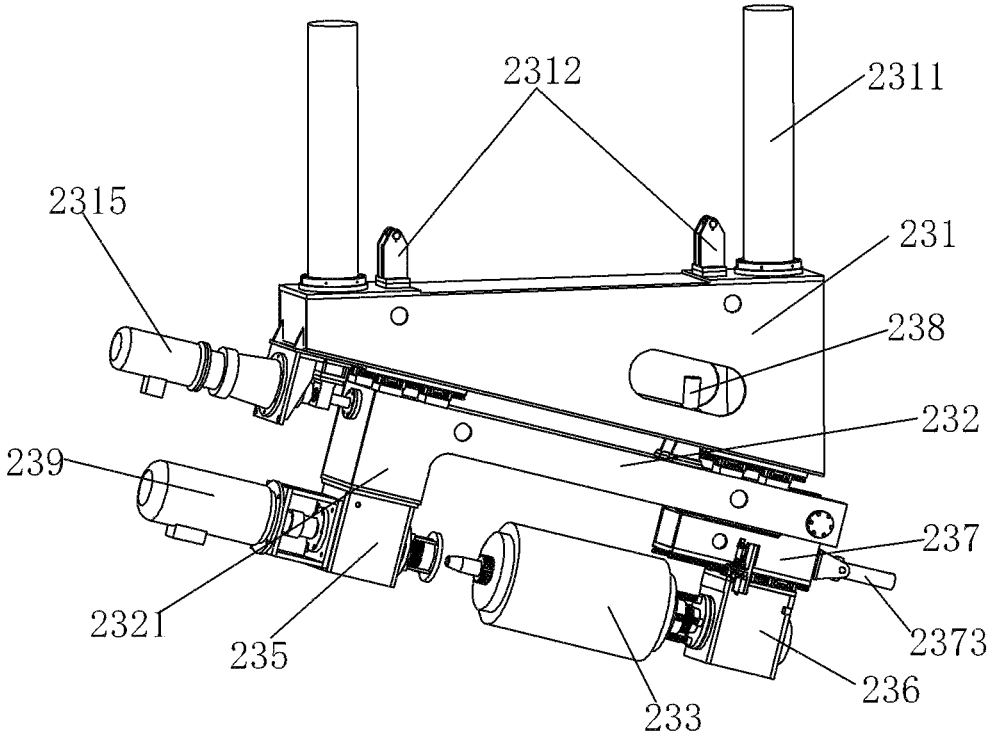
FIG. 8 is the first schematic view illustrating a structure of a first steel wire descaling mechanism.
Figure 9:
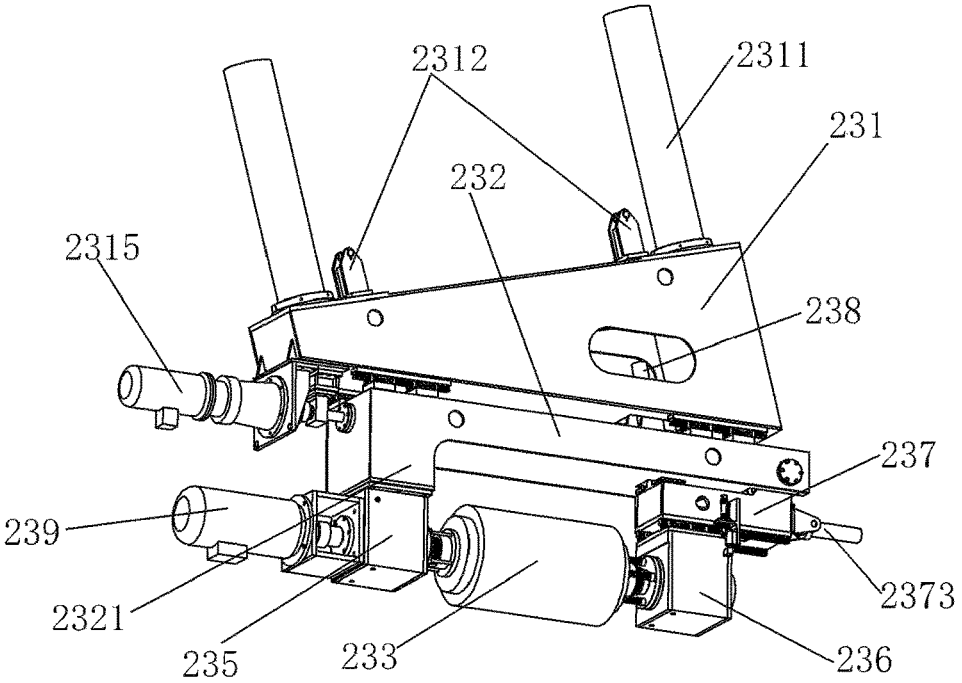
FIG. 9 is the second schematic view illustrating the structure of the first steel wire descaling mechanism.
Figure 10:
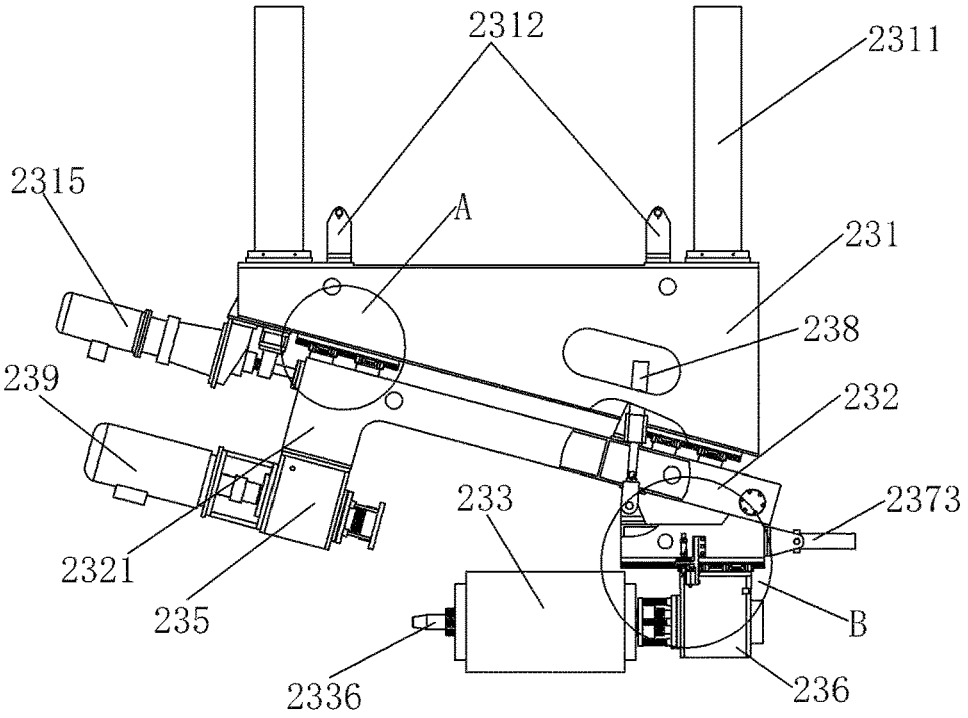
FIG. 10 is the third schematic view illustrating the structure of the first steel wire descaling mechanism.
Figure 11:
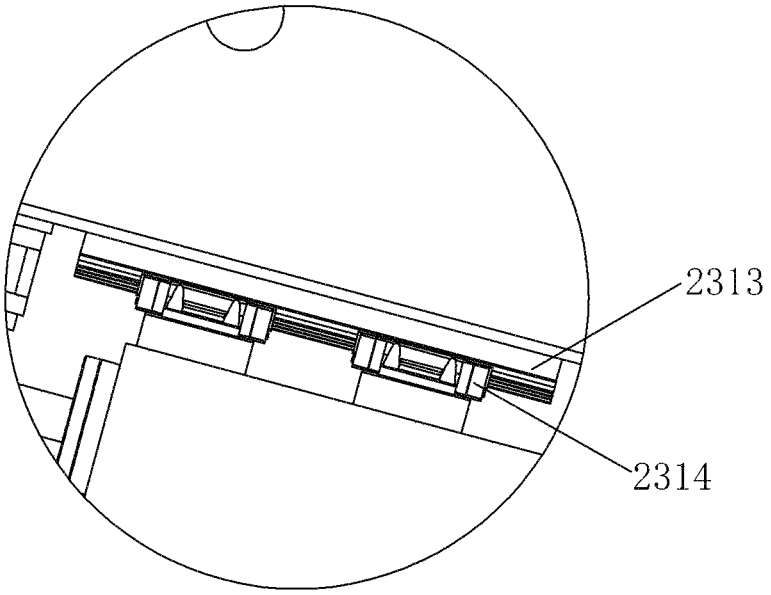
FIG. 11 is a partially enlarged view of A in FIG. 10.
Figure 12:
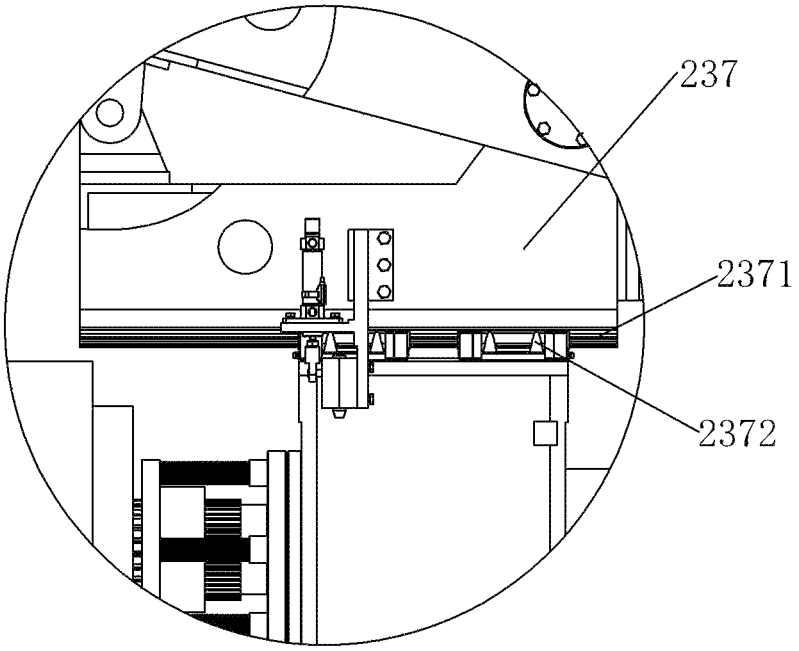
FIG. 12 is a partially enlarged view of B in FIG. 10.
Figure 18:
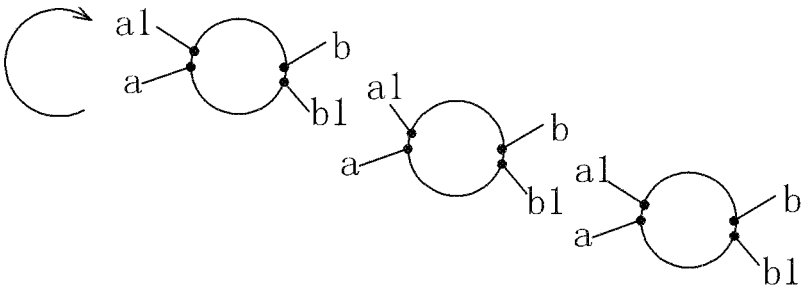
FIG. 18 is a schematic view illustrating that a steel wire is turned by a steel wire turning mechanism.
Figure 19:
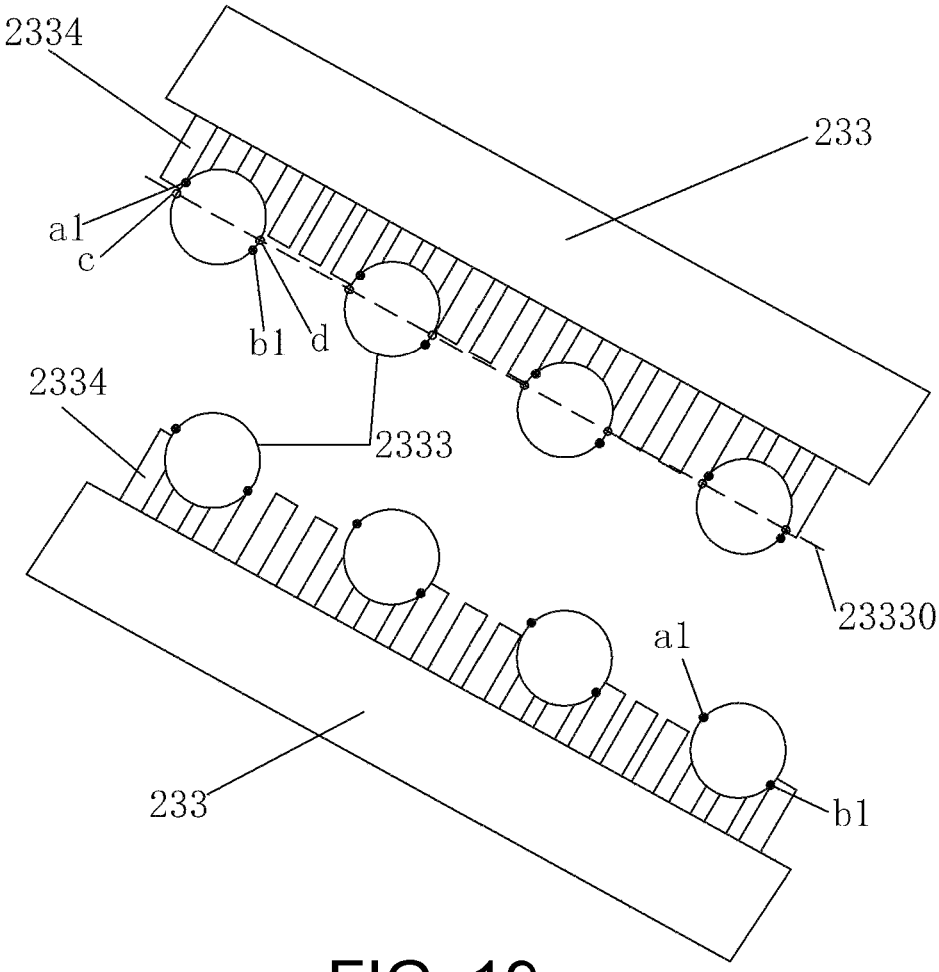
FIG. 19 is a schematic view illustrating removing oxide scales of steel wires from upper and lower surfaces of an inclined plane where the steel wires are located by using the first steel wire descaler.

To address such issue, the steel wires 2333 are arranged in parallel on a horizontal plane, and then the steel wires 2333 are entered into the steel wire turning mechanism 22, so that the steel wires 2333 are arranged in parallel on an inclined plane, as shown in FIGS. 3 and 4. FIG. 18 is a schematic view illustrating the turned steel wires after the steel wires pass through the steel wire turning mechanism 22 of the first steel wire descaler. After the steel wires pass through the steel wire turning mechanism 22, the entire plane formed by the steel wires arranged in parallel is turned a degree. Through the torque that turns the entire plane from a horizontal plane to an inclined plane, the steel wires 2333 themselves are also turned a degree, such as 4 degrees to 6 degrees, along the circumferential direction. Accordingly, the descaling blind region a and the descaling blind region b, which cannot be reached by brushing flatly, are respectively turned to positions a1 and b1. As shown in the top part of FIG. 19, in the first type of the first steel wire descaler, in order to cope with the inclined plane formed by the steel wires, the descaling roller 233 is also disposed inclinedly. The descaling roller 233 removes oxide scales from the inclined upper surfaces of the steel wires, and the position a1 after turning, which is originally the descaling blind region a, can thus be brushed and cleaned by the descaling roller 233. As shown in the lower part of FIG. 19, in the second type of the first steel wire descaler, the descaling roller 233 removes oxide scales from the inclined lower surfaces of the steel wires, and the position b1 after turning, which is originally the descaling blind region b, can thus be brushed and cleaned by the descaling roller 233. However, for the same reason, a circular center connection line 23330 of the steel wires 2333 is parallel to the central axis of the descaling roller 233 in FIG. 19, and a descaling blind region c and a descaling blind region d are formed at the positions on two ends of the diameter of each of the steel wire 2333 where the circular center connection line 23330 passes through.

Figure 20:
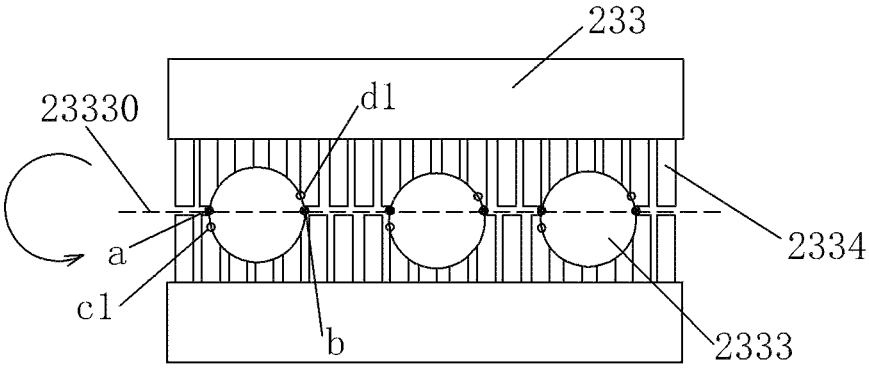
FIG. 20 is a schematic view illustrating removing oxide scales from steel wires by using a second steel wire descaler.
Figure 21:
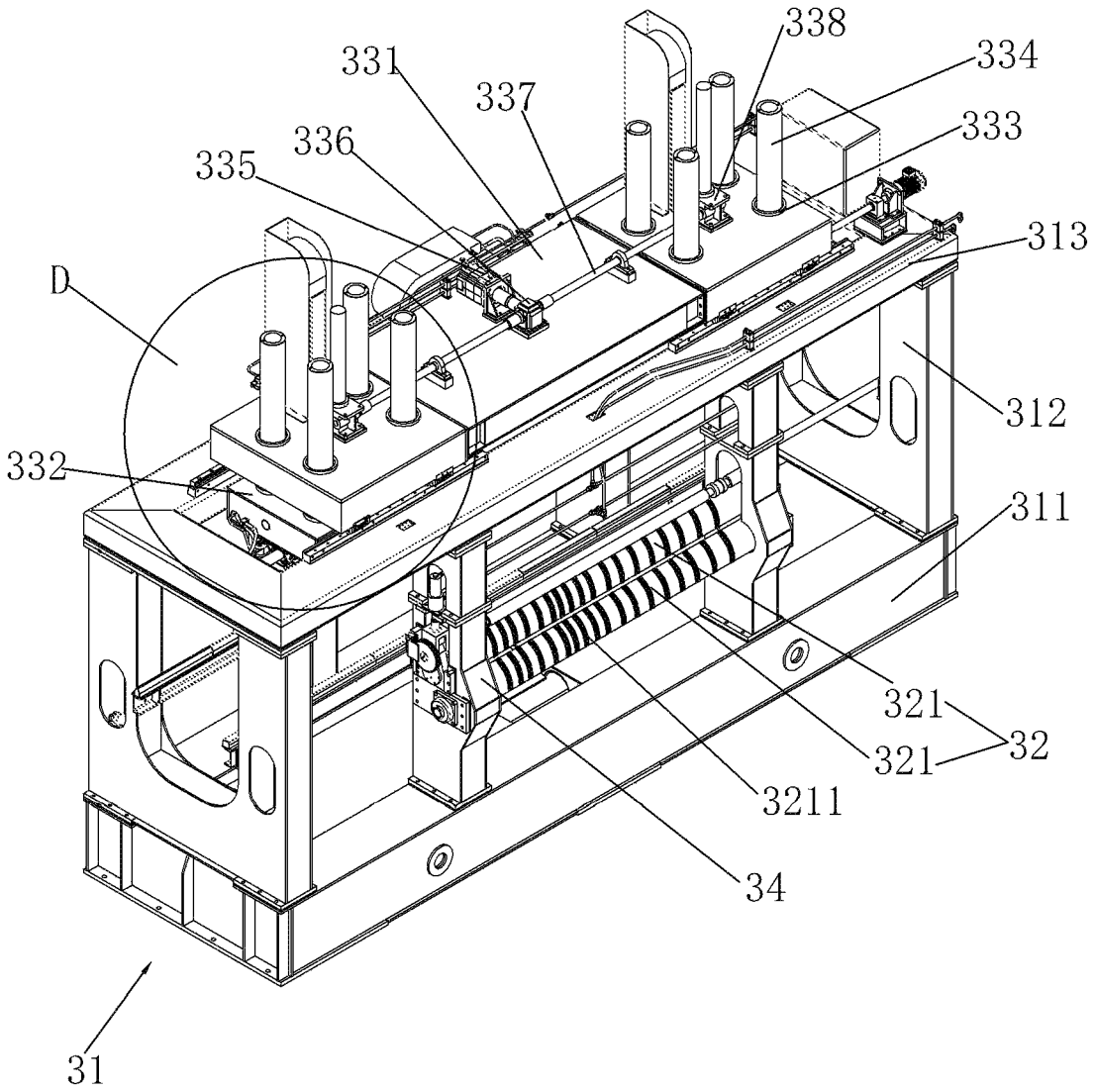
FIG. 21 is a schematic view illustrating a structure of the second steel wire descaler.
Figure 22:
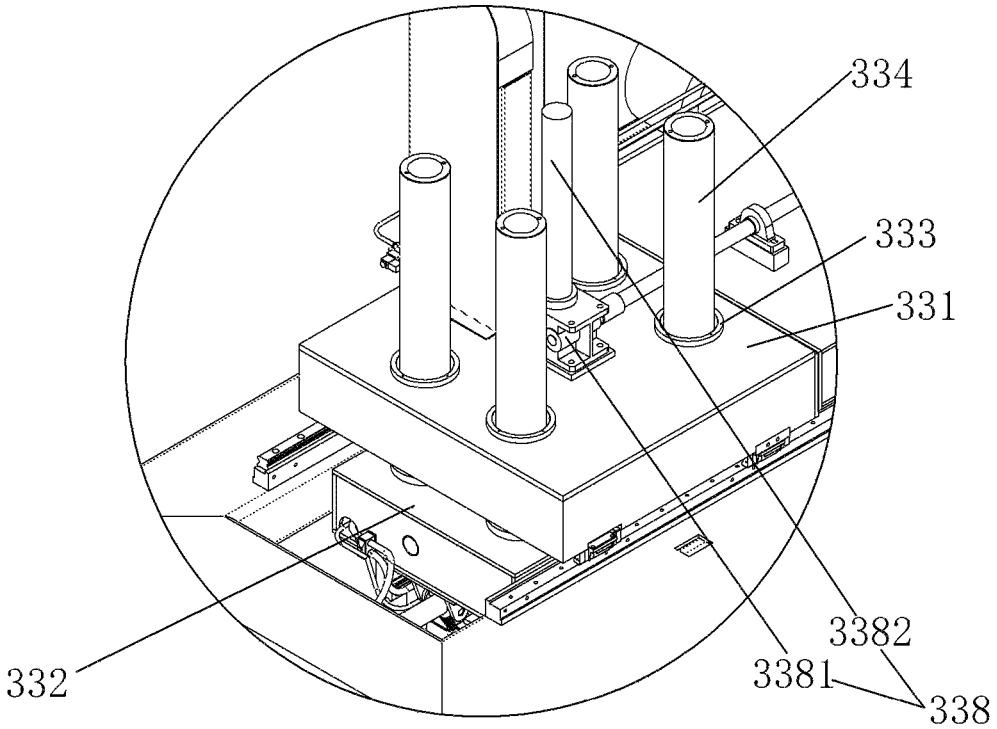
FIG. 22 is a partially enlarged view of D in FIG. 21.
Figure 23:
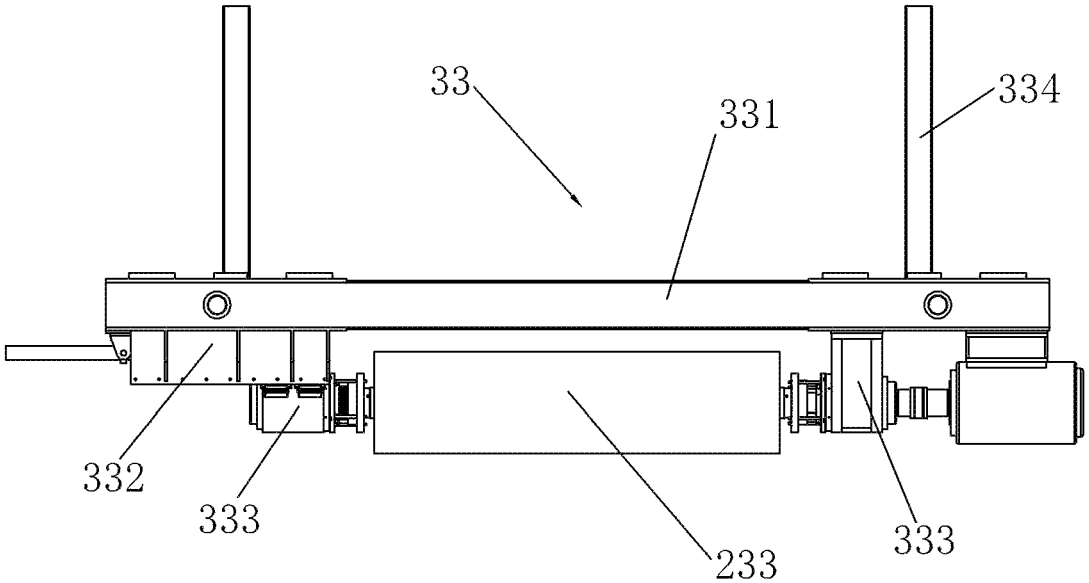
FIG. 23 is the first schematic view illustrating a structure of a liftable descaling mechanism.
Figure 24:
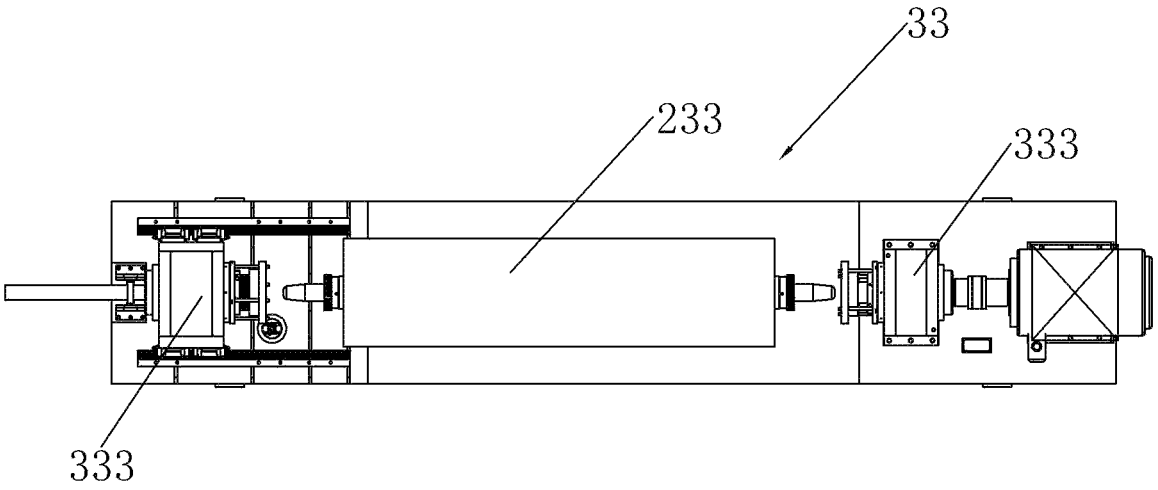
FIG. 24 is the second schematic view illustrating the structure of the liftable descaling mechanism.
Figure 25:
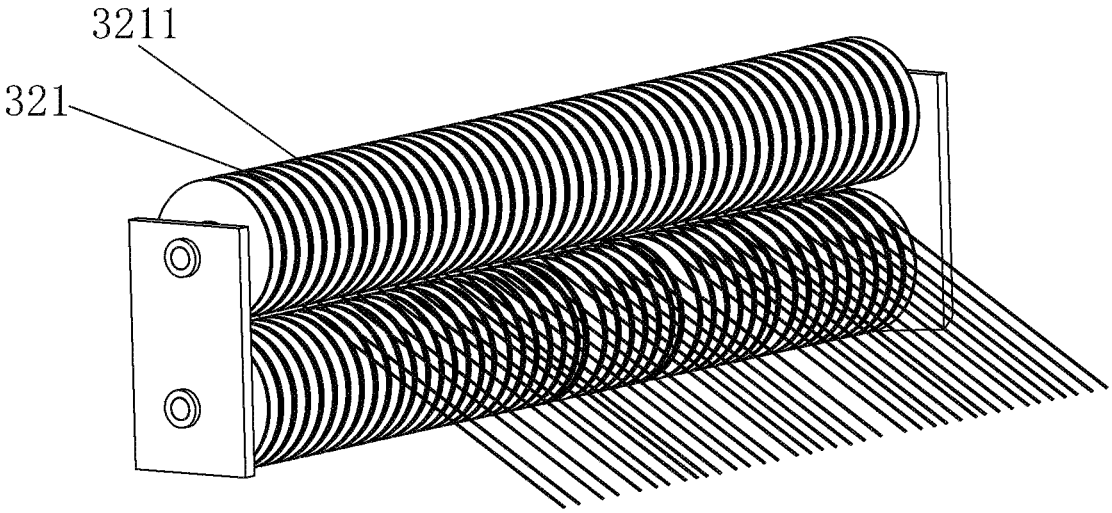
FIG. 25 is a schematic view illustrating a guiding roller.

After the descaling process on the steel wires 2333 by the first steel wire descaler, the steel wires 2333 are entered into the second steel wire descaler. The second steel wire descaler has two guiding rolls (not shown) disposed in parallel up and down, which are similar to separation rolls 121 in the steel wire separation assembly 12 in an unwinding machine 1. The guiding rollers are disposed horizontally. The guiding rollers are provided with grooves along the circumferential direction. In addition, the grooves are disposed at intervals along the axial direction of the guiding rollers. After the guiding rollers are arranged in parallel, grooves adjacent vertically form guiding roller paths for the steel wires to pass through. The inclined plane formed by the steel wires is turned back to the horizontal plane after the steel wires pass through the guiding rollers. Similarly, as shown in FIG. 20, the steel wires are turned again along the direction indicated by the arrow. That is, the regions corresponding to the positions a1 and b1 of the steel wires, which have been brushed, are returned to the positions of the descaling blind regions a and b on the left and right sides of the steel wires where the circular center connection line 23330 passes through. Meanwhile, the descaling blind regions c and d, which are yet to be brushed in the first steel wire descaler, are turned to positions c1 and d1 and can be brushed. By using the first and second steel wire descalers together as well as the turning of the steel wires themselves, the oxide scales of the steel wires 2333 can be completely removed along the circumferential direction without any blind spot.

The first steel wire descaler designed by the Applicant is capable of automatically replacing a roller. The roller replacement process thereof is described in the following.

Step 1: A roller-replacing trolley is pushed to right below the steel wire descaling mechanism 23 from the gap between the two pillars 212 on the side surface of the first steel wire descaler.

Step 2: The lifting motor 215 is started to drive the angle turner 201 to rotate, thereby synchronously rotating the two rotation shafts 217 on the two sides. The rotation shafts 217 then drive the first worm gears 204 on the two sides to rotate synchronously, thereby synchronously lowering the two first lifting sticks 216 and dropping the inclined beam 231 to a predetermined position. In this process, the guiding shafts 2311 move downward in the shaft sleeves 214, so the operation can be carried out stably.

Step 3: The second cylinder 2373 is started to drive the second sliding block 2372 to move outward along the second sliding rail 2371. Accordingly, the descaling roller 233 is detached from the first descaling roller bearing base 235. At this time, the first cylinder 238 is started to drive the second descaling roller bearing base 236 to rotate about the rotation connection point thereof to the horizontal position.

Step 4: A fixture on the trolley clamps the descaling roller 233, the trolley retreats, and the descaling roller 233 is separated from the second descaling roller bearing base 236.

Step 5: The replaced descaling roller 233 is removed and replaced with a new descaling roller 233, and the new descaling roller 233 is clamped by the fixture.

Step 6: The trolley is pushed to right below the steel wire descaling mechanism 23 from the gap between the two pillars 212 on the side surface of the first steel wire descaler. At this time, one end of the descaling roller 233 is installed to the second descaling roller bearing base 236. At this time, the fixture on the trolley stops clamping.

Step 7: The first cylinder 238 is started to pull the second descaling roller bearing base 236 upward to rotate about the rotation connection point to be parallel to the lower end surface of the inclined beam 231. At this time, the second cylinder 2373 is started to push the second sliding block 2372 to slide toward the inner side along the second sliding rail 2371. Accordingly, the other end of the descaling roller 233 is installed to the first descaling roller bearing base 235.

Step 8: The lifting motor 214 is started to drive the angle turner 201 to operate. Accordingly, the two rotation shafts 217 are rotated synchronously. The rotation shafts 217 drive the first worm gears 204 on the two sides to rotate synchronously, thereby driving the two first lifting sticks 216 to elevate synchronously, and the inclined beam 231 is thus lifted to a predetermined position.

In the steps above, Steps 2 and 3 are interchangeable, and Steps 7 and 8 are interchangeable.

The descaling process of the steel wire descaling device is described in the following.

The steel wires are entered into the first first steel wire descaler in the running direction of the streamline. The steel wires firstly pass through the deflector roller 211. Through the drive of the second deceleration motor 224, the beam lifting mechanisms 223 push the upper lateral beam 219 downward, thereby driving to lower the deflector rollers 221 installed thereon and limiting the steel wires within the guiding grooves 2213 of the upper and lower deflector rollers 221 to prevent the steel wires from jumping. Due to the structural properties of the deflector rollers 221, the steel wires receive a stress during this process and are turned an angle of about five degrees. The vertical position of the descaling roller 233 is adjusted by using the lifting motor 215, and the vertical position and the horizontal position of the descaling roller 233 are adjusted by using the first deceleration motor 2315. Accordingly, the oxide scales are removed from the inclined upper surfaces of the steel wires while the steel wires are moved forward. Then, descaling processes are further performed on the inclined upper surfaces of the steel wires by using multiple first steel wire descalers, so as to ensure the descaling effect. Then, the steel wires are entered into the second type of the first steel wire descaler. The second type of the first steel wire descaler perform a descaling process on the inclined lower parts of the steel wires. The second steel wire descaler removes oxide scales from the surfaces of the steel wires by brushing flatly. Since the oxide scales in the descaling blind regions a and b have been removed and cleaned by in the first steel wire descaler, the surfaces of the steel wires are thus thoroughly cleaned.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A steel wire descaling device, comprising one or more first steel wire descalers and one or more second steel wire descalers, wherein a descaling roller for removing an oxide scale from a surface of a steel wire is disposed on each of the first steel wire descaler and the second steel wire descaler, the descaling roller is disposed to rotate and thereby grind the surface of the steel wire, and the descaling roller of the first steel wire descaler is disposed inclinedly, the descaling roller of the second steel wire descaler is disposed horizontally, wherein, axes of the descaling rollers of the first steel wire descaler and the second steel wire descaler are parallel to a plane on which a plurality of steel wires that are adjacent are located, when the steel wires are arranged in parallel at intervals to pass through the descaling roller of the first steel wire descaler, the plane where the steel wires are located is inclined with respect to a horizontal plane, when being brushed and ground by the descaling roller of the second steel wire descaler after the steel wires are brushed and ground by the descaling roller of the first steel wire descaler and entered into the second steel wire descaler, the plane where the steel wires are located is restored to be horizontal.

2. The steel wire descaling device as claimed in claim 1, wherein the first steel wire descaler comprises a first descaler frame, a steel wire turning mechanism, and a steel wire descaling mechanism, the steel wire turning mechanism comprises at least one steel wire turning mechanism disposed at a steel wire inlet of the first descaler frame, and the steel wire descaling mechanism is disposed behind the steel wire turning mechanism located at the steel wire inlet.

3. The steel wire descaling device as claimed in claim 2, wherein the steel wire turning mechanism comprises two conical deflector rollers, the conical deflector rollers are installed in opposite directions and conical surfaces of the two deflector rollers are closely fit to each other, the conical surfaces are arranged to be inclined with respect to the horizontal plane, the deflector rollers each comprise a deflector roller shaft, a plurality of deflector wheels are installed on the deflector roller shaft, diameters of the respective turning wheels increase arithmetically from one end to another end of the deflector roller, each of the deflector wheels is independently rotatable about the deflector roller shaft, surfaces of all the deflector wheels together form the conical surface of the deflector roller, and guiding grooves for the steel wires to pass through are provided on a side surface of the deflector roller.

4. The steel wire descaling device as claimed in claim 2, wherein the steel wire descaling mechanism comprises an inclined beam, a descaling roller base is installed to a lower end of the inclined beam, the descaling roller is installed to the descaling roller base, a first sliding rail is disposed at the lower end of the inclined beam, two sliding blocks are installed on the first sliding rail, lower ends of the two first sliding blocks are respectively connected with two sides of an upper end of the descaling roller base, and a first deceleration motor is installed on a side of the oblique beam and drives the descaling roller base to move back and forth along the first sliding rail.

5. The steel wire descaling device as claimed in claim 4, wherein a first descaling roller bearing base and a second descaling roller bearing base are disposed on two sides of a lower end of the descaling roller base, at least one of the first descaling roller bearing base and the second descaling roller bearing base is movable back and forth, and a third deceleration motor for driving is installed to one of the first descaling roller bearing base and the second descaling roller bearing base.

6. The steel wire descaling device as claimed in claim 5, wherein elastic auxiliary mechanisms are installed to opposing sides of the first descaling roller bearing base and the second descaling roller bearing base, inner gears are installed to the elastic auxiliary mechanisms, outer gears are installed to two ends of the descaling roller, and the descaling roller is installed by engaging the inner gears and the outer gears with each other.

7. The steel wire descaling device as claimed in claim 6, wherein the elastic auxiliary mechanism comprises an installation seat, a plurality of screws are evenly installed along a circumferential direction on the installation seat, a disc spring is sleeved on each of the screws, the screws pass through the inner gear, one end of the disc spring contacts the installation seat, another end of the disc spring contacts a rear end surface of the inner gear, and an adjustment nut is installed to another end of the screw.

8. The steel wire descaling device as claimed in claim 6, wherein a gear shaft is engaged and sleeved with the inner gear, an exposed end of the gear shaft is provided with a chamber for the descaling roller to insert, the gear shaft is constantly engaged with the inner gear, the exposed end of the gear shaft is retracted with respect to a front end surface of the inner gear to provide a space for the outer gear to enter, gear teeth of the inner gear comprise long teeth and short teeth arranged at intervals, a preset gap for the outer gear is formed between the adjacent long teeth, the outer gear is a comb gear, a number of gear teeth of the outer gear ranges from a quarter to four-fifths of tooth side gaps of the inner gear.

9. The steel wire descaling device as claimed in claim 1, wherein the second steel wire descaler comprises a second descaler frame and a guiding roller installed on the second descaler frame, the guiding roller comprises two gathering rollers disposed in parallel up and down, a plurality of annular-shaped, groove-like roller paths are evenly arranged on surfaces of the gathering rollers, and the roller paths respectively correspond to each other between the two gathering rollers.

10. The steel wire descaling device as claimed in claim 1, wherein a plurality of flexible grinding rods are distributed on the descaling roller, the grinding rod has a resin-based bar-like structure, rigid grinding particles are provided in the grinding rod, and when the descaling roller is rotating, the grinding particles are exposed as the grinding rod is worn by repetitively contacting and brushing the steel wires, thereby grinding the steel wires by using the grinding particles.

* * * * *